US005755189A

United States Patent [19]

Godeau et al.

[11] Patent Number: 5,755,189

[45] Date of Patent: May 26, 1998

[54] INTERCONNECTION FRAME FOR AN ENGINE HAVING RIGID ELONGATE CONDUITS

[75] Inventors: Denis Godeau, Vieilles Maisons/Joudry; Anthony Garcia, Villemandeur, both of France

[73] Assignee: Hutchinson, Paris, France

[21] Appl. No.: 699,240

[22] Filed: Aug. 19, 1996

[30] Foreign Application Priority Data

Sep. 15, 1995 [FR] France ..... 95 10829
Sep. 28, 1995 [FR] France ..... 95 11387

[51] Int. Cl.[6] ..... F01P 9/00

[52] U.S. Cl. ..... 123/41.01; 123/41.54

[58] Field of Search ..... 211/182; 248/671; 180/68.4, 229, 291, 299; 123/41.01, 41.54, 41.55, 195 A

[56] References Cited

U.S. PATENT DOCUMENTS 4,640,341 2/1987 Ozawa ..... 180/229

FOREIGN PATENT DOCUMENTS 874337 8/1942 France .
356312 8/1961 Switzerland .
2249347 5/1992 United Kingdom .

*Primary Examiner*—Noah P. Kamen
*Attorney, Agent, or Firm*—Bell Seltzer Intellectual Property Group of Allston & Bird LLP

[57] ABSTRACT

The present invention relates mainly to interconnection apparatus, in particular hydraulic and pneumatic interconnection apparatus for the various members of a motor vehicle internal combustion engine. According to the invention, rigid elongate conduits are assembled together to form a self-supporting interconnection frame. Advantageously, the conduits are completed and/or extended by hoses where passages are difficult and/or in zones subjected to severe stresses, in particular vibration. Advantageously, the frame includes means for fixing electric cables, optical fiber cables, and/or bundles of cables. The present invention is mainly applicable to the automotive industry.

13 Claims, 4 Drawing Sheets

INTERCONNECTION FRAME FOR AN ENGINE HAVING RIGID ELONGATE CONDUITS

The present invention relates mainly to interconnection apparatus, in particular for hydraulic and pneumatic interconnections between the various members of a motor vehicle internal combustion engine.

BACKGROUND OF THE INVENTION

Proper operation of a motor vehicle engine cannot be achieved without interconnecting various pneumatic, hydraulic, and electrical circuits connecting various members of the engine to one another and to external devices. When the vehicle is assembled, or during maintenance thereof, it is therefore essential to be able to pass and connect numerous elongate bodies, in particular flexible hoses, rigid pipes, cables, or bundles of cables in the engine compartment.

That gives rise to numerous problems for motor vehicle manufacturers.

The paths followed by the various elongate bodies need to take account not only of the space available in the engine compartment, but also of proximity to hot elements such as parts of the engine or certain tubular ducts that risk compromising proper operation of elongate bodies that are fragile or that contain cold liquids. Similarly, it may be necessary to hold cables away from sources of electrical and/or magnetic disturbance. This problem is particularly important for flexible elongate bodies whose position can vary when they are subjected to vibration. Motor vehicle manufacturers have therefore been obliged to design elongate body paths that provide good safety at the expense of not making optimum use of the space available inside the engine compartment.

It is also necessary at all costs to avoid connection errors which means that connectors must have keying means to prevent wrong connection and/or that robotized assembly lines should be used. It should be observed that robotized assembly does not prevent future connection errors occurring during maintenance, e.g. when replacing a hose. Also, the disposition of elongate bodies in the engine compartment of a motor vehicle spoils the appearance of the engine unit.

OBJECTS AND SUMMARY OF THE INVENTION

Consequently, an object of the present invention is to provide reliable interconnection apparatus for the various members of a motor vehicle engine.

Another object of the present invention is to provide apparatus that enables optimized interconnections to be achieved by implementing elongate bodies that are short.

Another object of the present invention is to provide interconnection apparatus of pleasing appearance that matches that of the engine unit.

Another object of the present invention is to provide an engine unit fitted prior to installation in the engine compartment with apparatus that provides at least some of the connections required for proper operation thereof.

The invention achieves these objects by rigid elongate conduits together so as to form a self-supporting interconnection frame. Advantageously, the rigid elongate conduits are completed and/or extended by hoses in difficult passages and/or in zones subjected to severe stresses, in particular vibrations. Advantageously, the frame includes means for fixing electric cables, optical fiber cables, and/or bundles of cables.

Advantageously, the frame includes means for fixing measuring members, regulation members, and/or members for controlling fluid flows.

The invention mainly provides a self-supporting interconnection frame for a motor vehicle heat engine, the frame comprising both a plurality of elongate rigid conduits forming the structure of the frame and extending along at least one side of the engine block to the vicinity of members to be interconnected, and fixing means for fixing the frame to the engine.

The invention also provides a frame, including an incorporated water tank.

The invention also provides a frame, wherein the water tank includes connection means for direct connection to the cooling water inlet and outlet of a heat engine.

The invention also provides a frame, wherein the water tank includes a hot water inlet suitable for connection to the outlet of the water pump of a motor vehicle heat engine and connected to the hot water outlet of the water tank which is connected to a pipe leading to the hot water inlet of a radiator, and a cold water inlet connected to a pipe for conveying water cooled by a radiator and connected to a cold water outlet suitable for connection to the cooling water inlet of a motor vehicle heat engine.

The invention also provides a frame, including means for releasably holding electrical or optical cables or other fluid transfer ducts.

The invention also provides a frame, including an incorporated expansion chamber.

The invention also provides a frame, including hoses connected to the rigid elongate conduits and providing connections in zones that are subjected to severe stresses, in zones for making connections to members of the engine, and/or in zones that correspond to paths that are awkward or difficult.

The invention also provides a frame, wherein the ends of the pipes, and in particular the hoses, are provided with connection devices, in particular with quick couplings.

The invention also provides a frame, wherein the rigid elongate conduits are formed as a single piece by forming or extruding plastics materials.

The invention also provides a frame, wherein the rigid elongate conduits are made by assembling together a plurality of parts made of plastics material.

The invention also provides an engine unit, including a frame of the invention.

The invention also provides an engine unit, including a radiator connected to the engine by hoses and by rigid pipes, wherein the engine includes:

a heat exchanger connected to the cooling circuit via hoses and rigid pipes;

hoses and rigid pipes for connection to the vehicle cabin heater; and a rigid pipe connected to a hose connected to the admission manifold.

BRIEF DESCRIPTION OF THE DRAWINGS

The invention will be better understood from the following description and the accompanying figures given as a non-limiting example, and in which:

In FIGS. 1*a* to 2*b* the same references are used to designate the same elements.

MORE DETAILED DESCRIPTION

Figure 1A:
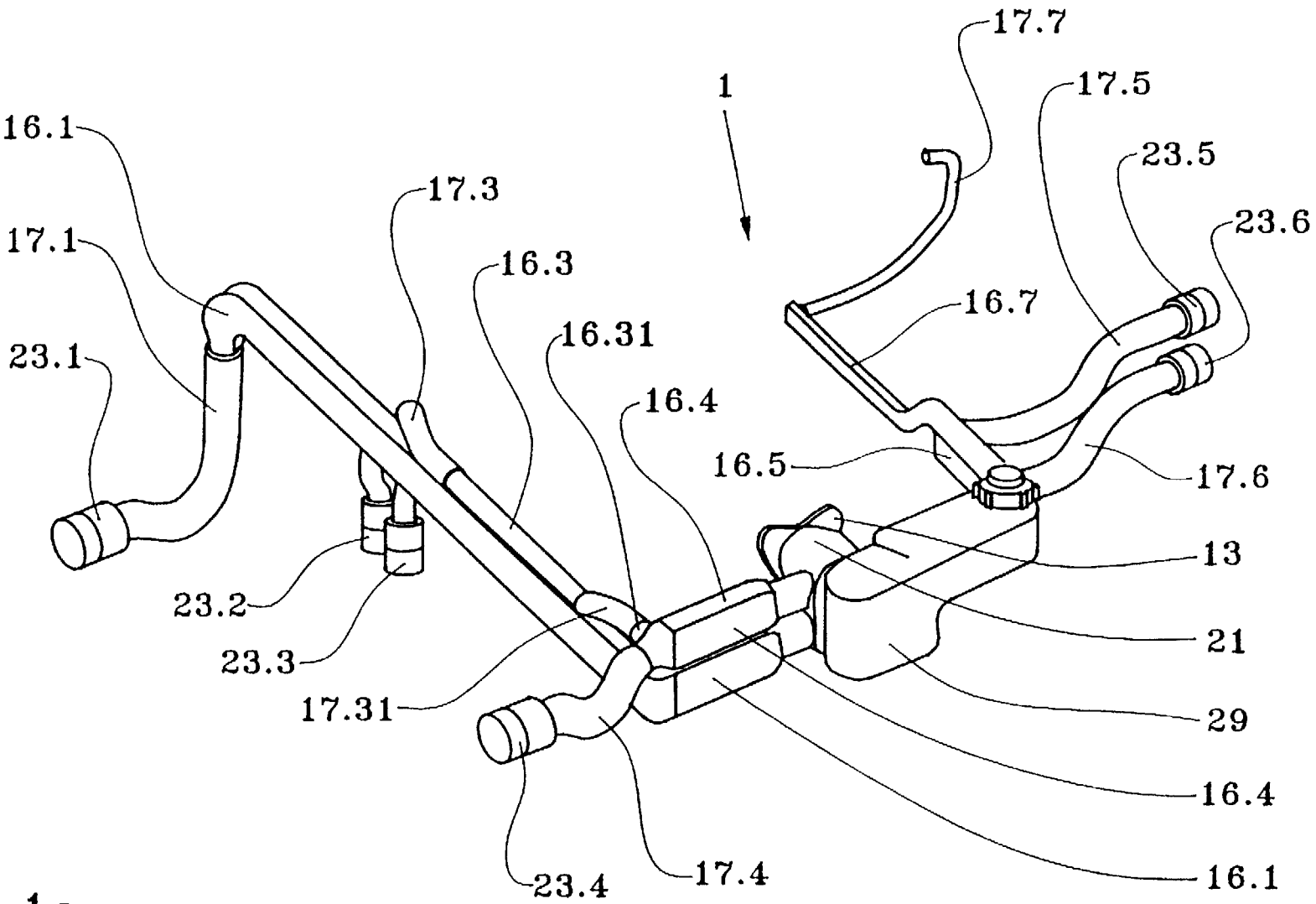
FIG. 1*a* is a front three-quarter perspective view from above of the preferred embodiment of the apparatus of the present invention.

In the figures, there can be seen the preferred embodiment of a cradle 1 of the invention comprising a first branch 3 of length substantially equal to the width of an engine block 5 (FIGS. 1*b* and 2*b*), a second branch 7 parallel to the first branch 3 and of length substantially equal to half the width of the engine block 5, and interconnected by a third branch 9 which is orthogonal to the branches 3 and 7. The branch 9 carries a fixing plate 13 for fixing the frame 1 to the engine block 5.

The frame 1 of the present invention is advantageously made of plastics material, e.g. by extrusion blow-molding or by rotational molding. Advantageously, the frame 1 of the invention is made by assembling together, by heat sealing or adhesive, elements that are themselves obtained by molding, by injection, by extrusion, or by extrusion blow-molding. The rigid parts are advantageously made of plastics material, although making the frame out of metal or other material would go beyond the ambit of the present invention. Hoses are made of plastics material or advantageously of elastomer. Hoses are advantageously fixed to the rigid pipes by overmolding a plastics cuff, or by installing a collar, a quick connector, etc. Advantageously, the ends of hoses remote from those connected to the rigid pipes of the frame are provided with quick couplings. The frame of the invention may be provided with means for absorbing vibrations, with electromagnetic screening disposed around signal transmission cables in the vicinity of sources of electromagnetic disturbance, and thermal insulation means disposed around pipes or signal transmission cables in the vicinity of heat sources.

The frame 1 includes means 15 for fixing electric cables 19.

The configuration of the frame of the present invention is a function of the engine 5 to be fitted, and in particular of the layout of the various members and the various fluid inlets and outlets of the engine.

Figure 1B:
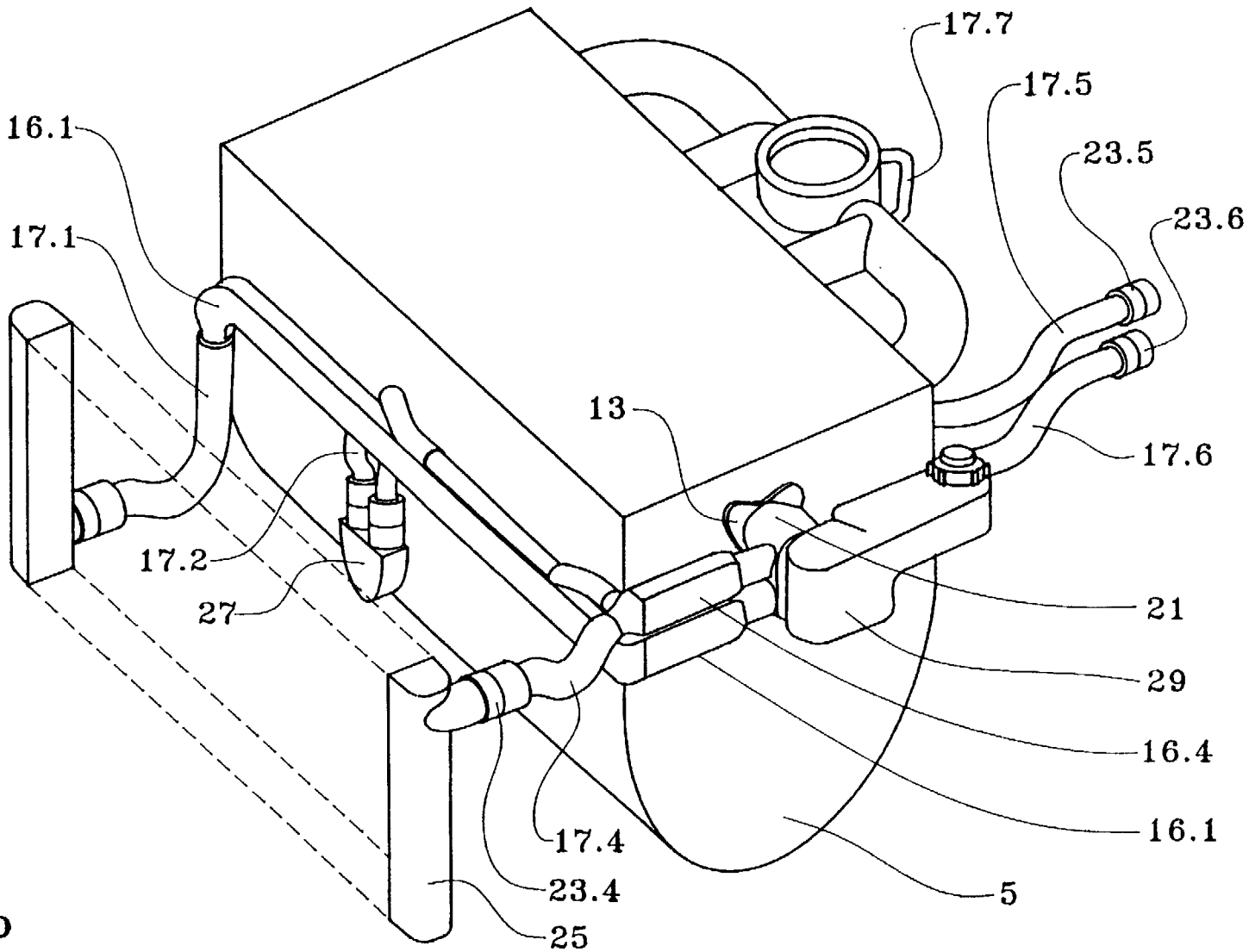
FIG. 1*b* is an analogous view of an engine block fitted with the FIG. 1*a* apparatus.
Figure 2A:
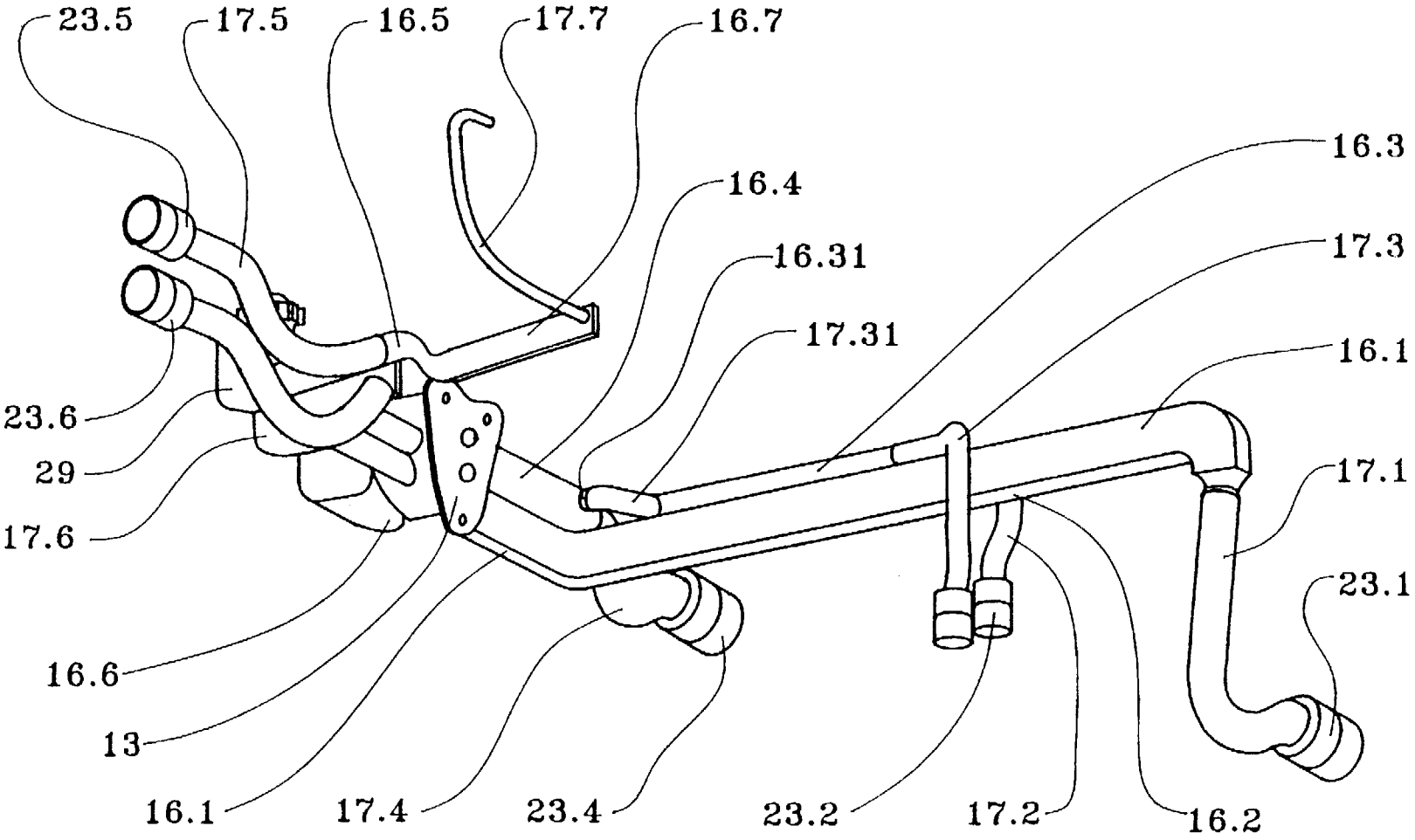
FIG. 2*a* is a back three-quarter perspective view from below of the FIG. 1*a* apparatus.
Figure 2B:
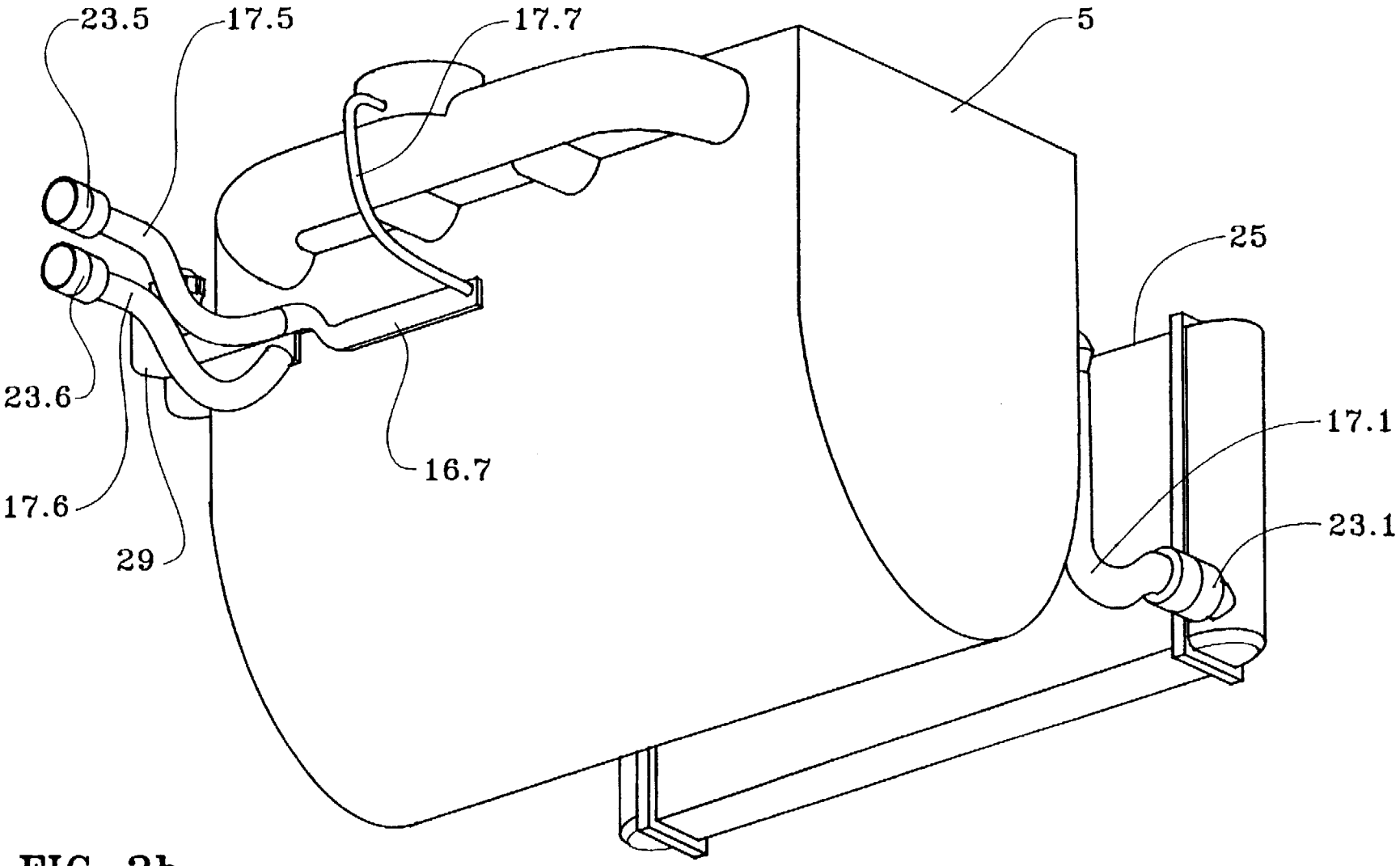
FIG. 2*b* is a view analogous to FIG. 2*a*, showing an engine block fitted with the apparatus of the invention.

In the example shown in FIGS. 1*b* and 2*b*, the pump outlet of the engine block 5 is coupled to a tank 21 for water inlet, distribution, and outlet, which tank is incorporated in the frame of the present invention level with fixing element 13. The tank 21, carried by the rigid elongate conduits, advantageously serves to distribute hot water coming from the engine block 5 and/or to distribute water that has been cooled in a radiator 25. In the example shown, a rigid pipe 16.1 extended by a hose 17.1 itself terminated by a quick coupling 23.1 connects a cold water inlet of the tank 21 to the cold water outlet of the radiator 25. A pipe 16.4 extended by a hose 17.4 itself terminated by a quick coupling 23.4 connects the hot water outlet of the tank 21 to the hot water inlet of the radiator 25. A branch 16.31 on the pipe 16.4 is connected via a hose 17.31, a rigid pipe 16.3, and a hose 17.3, itself terminated by a quick coupling 23.3 to the outlet of a heat exchanger 27 for cooling engine oil. The inlet of the heat exchanger 27 is connected via a hose 17.2 terminated by a quick coupling 23.2 to a branch 16.2 on the pipe 16.1. A motor vehicle cabin heater is fed by a pipe 16.5 connecting the tank 21 to a hose 17.5 terminated by a quick coupling 23.5. Water return from the heater to the tank 21 takes place via a quick coupling 23.6, a hose 17.6, and a rigid pipe 16.6. A pipe 16.7 terminated by a hose 17.7 connects the tank 21 to the admission manifold of the vehicle engine. It should be observed that the hoses 17.1 to 17.7, being flexible, facilitate connection and assembly, preventing transmission of forces and in particular of vibrations, and facilitate passage into zones that are difficult of access or awkward in shape. Advantageously, the pipes 16.1 to 16.7 are rectangular in section, optimizing the stiffness of the frame of the present invention. Nevertheless, implementing pipes of other shapes, in particular of other sections, would naturally not go beyond the ambit of the present invention. Advantageously, the hoses 17.1 to 17.7 are circular in section. Advantageously, the rigid pipes include transition zones to regions of circular section facilitating assembly of the hoses.

Advantageously, the frame 1 of the present invention includes an integral expansion chamber 29 carried by the rigid elongate conduits.

The frame of the present invention serves to pass the cables necessary for operation of the engine, e.g. cables connecting the ignition system to the engine spark plugs, or the cables connecting the electricity power supply to the ignition system and to the starter. The frame of the present invention also serves to pass electrical or optical cables for interconnecting the engine with other members of the vehicle, e.g. cables connecting the various sensors for detecting proper operation of the engine to the vehicle dashboard.

The present invention applies mainly to the automotive industry.

We claim:

1. Apparatus for providing connection to various components of a motor vehicle engine, said apparatus comprising:

a plurality of rigid elongate conduits assembled together to form a self-supporting interconnection frame, the respective conduits having ends positioned and arranged for attachment to the motor vehicle engine, at least one fixing plate carried by said elongate conduits for affixing the interconnection frame to the engine, and connection means provided at ends of the elongate conduits for connection to various components of the motor vehicle engine.

2. The apparatus of claim 1, further wherein said connection means include hoses attached to ends of said rigid elongate conduits.

3. The apparatus of claim 2, wherein said connection means additionally includes quick disconnect couplings carried by said hoses.

4. The apparatus of claim 1, further comprising a water tank connected to said elongate conduits, wherein said connection means includes couplings for direct connection to the cooling water inlet and outlet of the engine.

5. The apparatus of claim 1, further comprising an expansion chamber integral with said elongate conduits.

6. The apparatus of claim 1, wherein said rigid elongate conduits are formed of plastic.

7. The apparatus of claim 1, wherein each said rigid elongate conduit comprises a unitary piece of extruded plastic.

8. A motor vehicle engine unit comprising:

an engine having various circuits with components requiring interconnection; and a self-supporting interconnection frame for interconnecting said components of said engine, said frame comprising a plurality of rigid elongate conduits assembled together, the respective conduits having ends requiring attachment to said components of the engine, at least one fixing plate carried by said elongate conduits and affixing the interconnection frame to the engine, and connection means provided at the ends of said elongate conduits and connecting to said components of the motor vehicle engine.

9. The engine unit of claim 8, further wherein said connection means include hoses attached to ends of said rigid elongate conduits.

10. The engine unit of claim 9, wherein said connection means additionally includes quick disconnect couplings carried by said hoses.

11. The engine unit of claim 8, further comprising a water tank connected to said elongate conduits, wherein said connection means includes couplings for direct connection to the cooling water inlet and outlet of the engine.

12. The engine unit of claim 8, further comprising an expansion chamber integral with said elongate conduits.

13. The engine unit according to claim 8, further comprising:

an expansion chamber carried by said rigid elongate conduits, a water tank carried by said rigid elongate conduits and a radiator connected to said engine by at least one of said rigid elongate conduits.

* * * * *